United States Patent [19]

Higashihara et al.

[11] Patent Number: 4,820,132

[45] Date of Patent: Apr. 11, 1989

[54] VARIABLE DISPLACEMENT WOBBLE PLATE TYPE COMPRESSOR

[75] Inventors: Shinichiro Higashihara; Terukazu Shinto, both of Tokyo, Japan

[73] Assignee: Nihon Radiator Co., Ltd., Tokyo, Japan

[21] Appl. No.: 97,144

[22] Filed: Sep. 16, 1987

[30] Foreign Application Priority Data

Sep. 19, 1986 [JP] Japan ..... 61-142619[U]

[51] Int. Cl.[4] ..... F04B 1/18; F04B 1/28

[52] U.S. Cl. ..... 417/222; 417/269

[58] Field of Search ..... 417/222, 269, 270; 403/348, 349; 91/499, 506

[56] References Cited

U.S. PATENT DOCUMENTS

| | | | |
|---|---|---|---|
| 226,453 | 4/1880 | Kelly | 403/348 |
| 1,762,776 | 6/1930 | Gardner | 403/348 |
| 4,019,342 | 4/1977 | Ohta | 62/469 |
| 4,428,718 | 1/1984 | Skinner | 417/222 |
| 4,543,043 | 9/1985 | Roberts | 417/270 |
| 4,602,554 | 7/1986 | Wagonseil | 91/499 |
| 4,712,982 | 12/1987 | Iwagaki | 417/222 |

FOREIGN PATENT DOCUMENTS

| | | | |
|---|---|---|---|
| 3638000 | 5/1987 | Fed. Rep. of Germany | 417/269 |
| 55-20690 | 2/1980 | Japan . | |
| 2153922 | 3/1985 | United Kingdom | 417/222 |

*Primary Examiner*—William L. Freeh

*Attorney, Agent, or Firm*—Foley & Lardner, Schwartz, Jeffery, Schwaab, Mack, Blumenthal & Evans

[57] ABSTRACT

A non-rotatary wobble plate is mounted on a plate which is pivotally mounted on a drive shaft in a manner that the orientation of the wobble plate and the driven plate can be varied. A thrust bearing is provided to accommodate the relative movement between the two plates and a spring, in the form of a plate spring, is provided to constantly bias the wobble plate against the thrust bearing so that noise and the like are not generated during high speed rotation of the driven plate.

5 Claims, 5 Drawing Sheets

VARIABLE DISPLACEMENT WOBBLE PLATE TYPE COMPRESSOR

BACKGROUND OF THE INVENTION

1. Field of the Invention

The present invention relates generally to a compressor for use in an automotive air conditioning system or the like and more specifically to a variable displacement wobble plate type compressor for such a system.

2. Description of the Prior Art

FIG. 1 schematically shows an air conditioning system of the type to which the present invention is applied. This system includes a compressor 1 which is driven by a prime mover (not shown) such as an internal combustion engine of an automotive vehicle via a belt and pulley arrangement. In this instance the pulley 2 is associated with a magnetic clutch via which the drive connection between the engine and the compressor can be selectively established. The clutch in this instance is depicted schematically as element *2a*.

The discharge port of the compressor is fluidly connected with an air cooled condensor 3 in a manner that the hot compressed refrigerant gas discharged from the compressor 1 is cooled via heat exchange with a flow of ambient air which passes over the cooling surfaces of the condensor. A liquid tank 4 is arranged downstream of the condensor 3 and adapted to separate and temporarily store any water and/or foreign matter from the liquified refrigerant before it is fed into an evaporator 5 via a temperature responsive expansion valve 6. This valve, as shown, is provided with a temperature sensor arrangement in the form of a bulb 7 filled with volatile fluid which is disposed in contact with the discharge port of the evaporator 5 so as to be exposed to the temperature of the gas which is discharged therefrom. The discharge port of the evaporator is, as shown, directly connected to the induction port of the compressor.

FIG. 2 shows a prior art type wobble plate compressor which has been used in the above described refrigeration system. A device of this nature is disclosed in U.S. Pat. No. 4,428,718 issued on Jan. 31, 1984 in the name of Skinner.

This device is arranged to be responsive to the pressure of the gaseous coolant which is fed to the compressor so that when the thermal load on the system is low such as tends to occur when the ambient temperature is low, the displacement of the compressor is reduced to avoid wasteful energy consumption. On the other hand, when the thermal load on the system is high, the displacement of the compressor is increased to accomodate the increased heat removal requirements.

In more detail, this arrangement includes a cylinder block 100 having a cylinder head 102 and a crankcase cover 104 sealingly secured to opposite ends thereof. A drive shaft 106 is supported centrally in the compressor at the cylinder block 100 and the crankcase cover 104 by radial needle bearings 108, 109 respectively. The drive shaft 106 is further axially retained by a thrust washer 110 which is disposed inward of the radial bearing 108 and a thrust needle bearing 112 located inboard of the radial bearing 109. The drive shaft 106 extends through the crankcase cover 104 for connection to prime mover such as an automotive engine or the like (not shown) by way of a pulley 114 which is selectively connectable to the drive shaft via an electromagnetic clutch 116.

The cylinder block 100 has five axially arranged parallel cylinders bores 120 (only one shown) which are equally spaced from the axis of the drive shaft 106 and arranged equidistantly thereabout. In this arrangement the cylinder bores 120 each receive a reciprocal piston 122 which includes seals (no numerals) which are received in annular grooves formed about the periphery thereof. Each of the pistons 122 is connected to an annular nonrotary wobble plate 124 via a piston rod 125. Each of the piston rods 125 is connected to its respective piston 122 by way of a universal joint. In this arrangement the joints are defined by a spherical rod end which is retained in a socket formed in the backside of the piston by a retainer which is swagged in place. The other end of each of the piston rods 126 is connected to the wobble plate 124 via a similarly constructed universal joint.

The wobble plate 124 is disposed coaxially about the drive shaft 106 and mounted on a rotary drive plate 126. The wobble plate 124 is supported on this drive plate 126 by a thrust bearing 128 and a radial bearing 130 and retained in place by a thrust washer 131 and a snap ring 132.

The drive plate 126 is operatively connected to the drive shaft 106 via a lug 134 which extends from the drive shaft 106 and protrudes through an axial slot (no numeral) formed in a sleeve member 135. The connection between the drive plate 126 and the lug 134 is achieved by a pin 136 which is received in a slanted slot 137. This arrangement permits the drive and wobble plates 126, 124 to undergo changes in inclination within the crankcase in a manner which permits the length of the piston strokes to change as will become more apparent hereinlater.

In order to prevent the wobble plate 124 from rotating with the drive plate 126 in the crank case, the lower end thereof (as seen in the drawings) is operatively connected to a guide pin 138 which is press fitted into bores formed in the cylinder block 100 and the crank case cover 104. Connection between the guide pin 138 and the wobble plate 124 is established by a ball guide 140 which is slidably received on the pin 138. The ends of the ball guide 140 are received in semi-cylindrical guides 141 (only one shown) which are disposed in a slotted section of the wobble plate 124. With this arrangement the ball guide 140 can rotate and move radially inwardly and outwardly in accordance with the change in angle of the wobble plate 124 within the crank case.

A valve plate 144 is sandwiched between the cylinder head 102 and cylinder block 100. This plate 144 closes the open ends of the cylinder bores 120 and is formed with a plurality of inlet and outlet ports 146, 148 which are respectively controlled by reed valves 150, 152. The reed valves 150 which control the inlet or induction ports 146 are arranged to be weaker than those which control the discharge or exhaust ports 148.

The cylinder head 102 is formed with an induction chamber 160 and a discharge chamber 162. These chambers respectively provide fluid communication between a main inlet port 164 formed in the cylinder head and all of the inlet valves and a main discharge port 166 (also formed in the cylinder head) and all of the exhaust valves.

A valve arrangement 170 which controls the pressure prevailing in the crank case is disposed in the cylinder head 102. The arrangement includes a chamber 172 in fluid communication with the discharge chamber 162; a ball valve 174 which control communication between the chamber 172 and bores 175, 176 which lead to the crank case; a chamber 178 in fluid communication with the induction chamber 160; a bellows 180 responsive to the induction pressure; a second valve element 182 which is arranged to control communication between the chamber in which the bellows 180 is disposed and bores 183, 184 which lead to the crank case. The arrangement further includes a valve rod 186 which is connected to the second valve element 182 and which lifts the ball valve element 174 (first valve) off its seat when the bellows 180 expands and urges the second valve element 182 to a closed position.

This valve arrangement 172 functions to control the angle of the drive and wobble plates 126, 124 within the crank case and therefore the length of the piston strokes. Viz., when the thermal load on the air conditioning system is high, the temperature and pressure of the gaseous refrigerant which is inducted into the induction chamber 160 are high. In response to this the bellows 180 is arranged to contract and induce the second valve 182 to open and the first 174 to close. This tends to induce the situation wherein the pressure in the crank case tends to become equal to that prevailing in the induction chamber 160.

Under these conditions, the pressure differential acting across the pistons 122 is such that a moment of force which tends to turn the wobble plate 124 toward its maximum amount of inclination within the crank case, is produced. This of course tends to lengthen the stroke of the piston towards its maximum valve increasing the capacity of the compressor.

Conversely, if the load on the air conditioning system is low, the relatively high discharge pressure is supplied into the crank case by the reverse setting of the first and second valves. Under these conditions the pressure in each cylinder undergoing induction is lower than that prevailing in the crank case. Thus, the pressure differential acting across the respective piston produces a moment of force via which the wobble plate 124 tends to be tilted toward its minimum amount of inclination. Subsequently, as the compression stroke advances the pressure in the cylinder becomes higher than that prevailing in the crank case whereby the moment of force which tends to turn the wobble plate 124 back toward its maximum inclination is produced. The equilibrium which is established between the two moments determines the actual angle of inclination and the stroke of the piston.

In the event that the load on the compressor drops below that which can be compensated by a change in the inclination of the wobble plate 124 the electromagnetic clutch 116 can be conditioned to disconnect the drive shaft from the prime mover.

For further details relating to the operation of this device reference may be had to the United States Patent referred to hereinbefore, the content of which is hereby incorporated by reference thereto.

However, with the above disclosed type of compressor a drawback has been encountered in that as the wobble plate 124 is held stationary and the drive plate 126 rotated relative thereto, a small clearance therebetween is inevitably required. However, this clearance which tends to increase with the passing of time, permits a small amount of movement or play between the two members which lead to the generation of noise when the drive plate is induced to rotate at high speeds. This tends to reduce the working life of device as well as being noisy.

SUMMARY OF THE INVENTION

It is an object of the present invention to provide a variable capacity wobble plate compressor which is capable of quiet operation and which exhibits a excellent working life.

In brief, the above object is achieved by a compressor arrangement which features non-rotary wobble plate is mounted on a plate which is pivotally mounted on a drive shaft in a manner that the orientation of the wobble plate and the driven plate can be selectively varied. A thrust bearing is provided to accomodate the relative movement between the two plates and a spring in the form of a plate spring is provided to constantly bias the wobble plate against the thrust bearing so that noise and the like are not generated during high speed rotation of the driven plate.

More specifically, the present invention takes the form of a wobble plate variable capacity compressor which features a drive shaft selectively connectable to a source of rotational energy; a drive plate pivotally connected to said drive shaft in a manner to be pivotal with respect thereto and synchronously rotatable therewith; a wobble plate operatively disposed on said drive plate, said wobble plate being supported on said drive plate by a thrust bearing and held stationary with respect to said drive plate in a manner that relative movement occurs therebetween when said drive shaft is driven to rotate; and a spring mounted on said driven plate, said spring applying a bias to said wobble plate which urges said wobble plate into constant engagement with the thrust bearing.

DETAILED DESCRIPTION OF THE PREFERRED EMBODIMENTS

Figure 1:
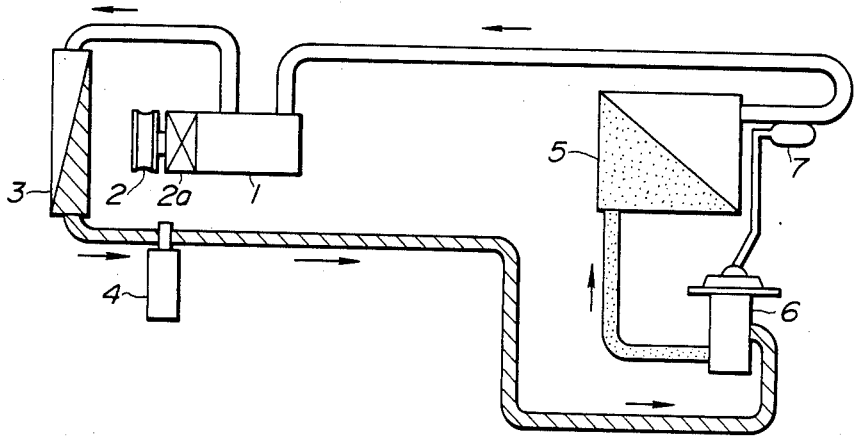
FIG. 1 schematically shows an air conditioning system of the type to which the present invention pertains and which is briefly discussed in the opening paragraphs of the instant disclosure.
Figure 2:
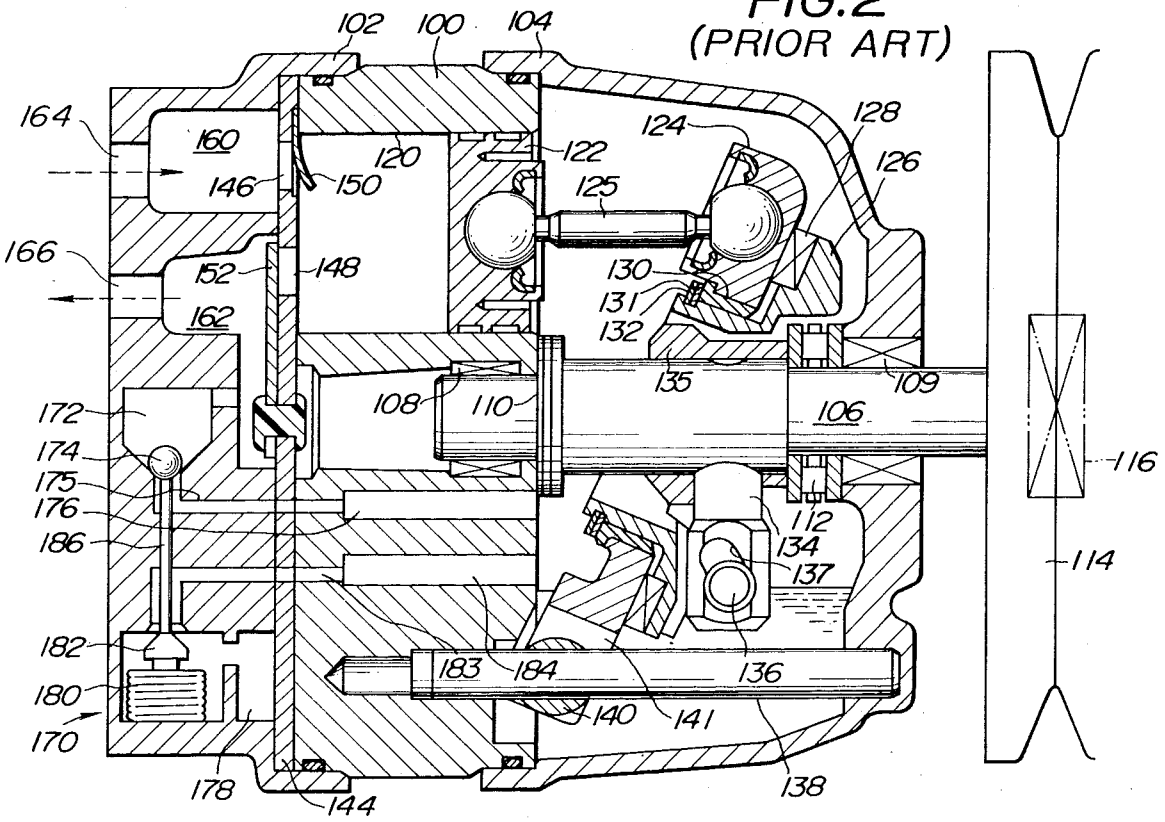
FIG. 2 (PRIOR ART)
FIG. 2 is a sectional elevation of a prior art compressor discussed in some detail in the opening sections of the instant disclosure.
Figure 3:
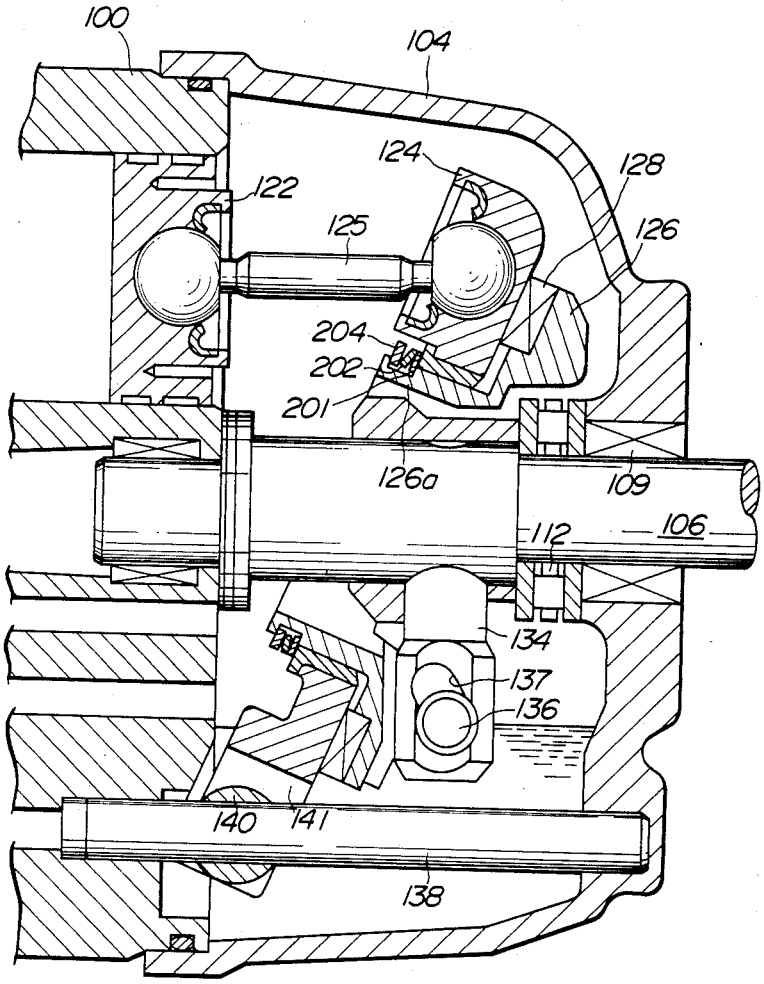
FIG. 3 is a sectional elevation of a wobble plate compressor according to a first embodiment of the present invention.
Figure 4:
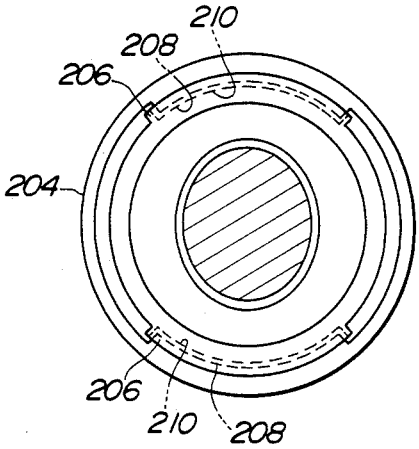
FIG. 4 is a sectional front elevation of the first embodiment showing the arrangement via which the plate spring which forms a vital part of the present invention is secured in place.
Figure 5:
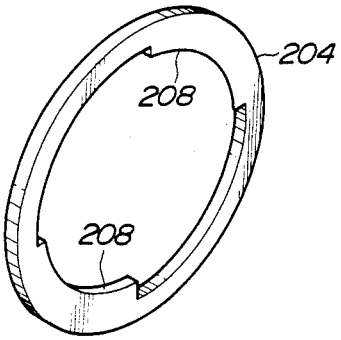
FIG. 5 is a perspective view showing the retainer which is used to hold the plate spring in position in the first embodiment.

FIG. 3 shows in sectional elevation a wobble plate compressor arrangement according to a first embodiment of the present invention. This arrangement is essentially similar to the prior art device disclosed hereinbefore and differs in that the thrust washer 131 and snap ring 132 combination are replaced with a washer 201—annular plate spring 202—retainer 204 combination. In this embodiment the annular axial extending section 126a of the drive plate 126 is formed with an annular recess which receives the washer 201, plate spring 202 and the retainer 204 in the illustrated manner. In order to securely retain the retainer 204 in place the forward edge of the drive plate 126 is formed with a plurality (in this case 2) of radially outwardly projecting crenulations 206. The retainer 204 is similarly formed with corresponding crenulations 208 (see FIG. 5). The combination of these elements defines a kind of bayonet coupling which enables the retainer to be inserted into the recess and rotated into the position illustrated in FIG. 4. To ensure that the retainer 204 will not vibrate out of the desired position, the crenulations 206 formed on the drive plate 126 are provided with recesses in their rear faces into which the crenulations 208 of the retainer can seat and lock. Under the bias of the plate spring 202 the retainer 204 is fixedly held in place and cannot accidently rotate to an angular position wherein it might be undesirably displaced from its intended position.

The plate spring 202 produces a bias which presses the radial bearing 130 back toward the drive plate 126. This of course biases the wobble plate 124 in the same direction and into constant contact with the thrust bearing 128. The spring constant of the plate spring 202 is selected to hold the wobble plate 124 against the thrust bearing 128 with sufficient force as to obviate any relative movement between the two members in the axial direction which will give rise to the generation of noise and the like but which does not induce excessive friction to be generated therebetween.

Figure 6:
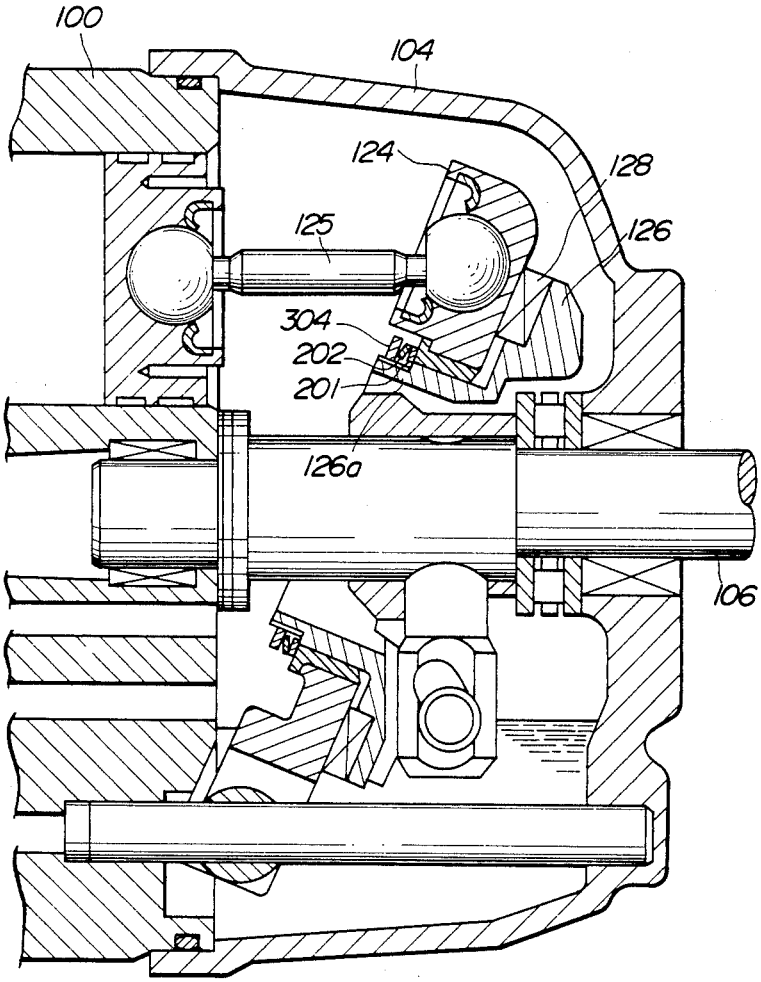
FIG. 6 is a sectional elevation of a compressor according to a second embodiment of the present invention.

FIG. 6 shows a second embodiment of the present invention. This arrangement features the construction wherein the retainer 304 is formed with a male thread and the annular axial extending portion of the drive plate 126a formed with a corresponding female thread. This arrangement permits the retainer to be threadedly screwed into place. Although not shown, it is within the scope of the present invention to use a second lock nut in combination with the threaded retainer.

What is claimed is:

1. In a wobble plate variable capacity compressor a drive shaft selectively connectable to a source of rotational energy:

a drive plate pivotally connected to said drive shaft in a manner to be pivotal with respect thereto and synchronously rotatable therewith;

a wobble plate operatively disposed on said drive plate, said wobble plate being supported on said drive plate by a thrust bearing and held stationary with respect to said drive plate in a manner that relative movement occurs therebetween when said drive shaft is driven to rotate; and a spring mounted and rotatably locked into a biasing position on said driven plate, said spring applying a bias to said wobble plate which urges said wobble plate into constant engagement with the thrust bearing.

2. A compressor as claimed in claim 1 wherein said spring takes the form of a plate spring and which further comprises means for retaining said plate spring in a predetermined position on said drive plate.

3. A compressor as claimed in claim 2 wherein said retaining means includes:

an annular retainer member, said retainer being formed with a plurality of first crenulations;

means defining a groove in said drive plate;

means defining a plurality of second crenulations about the mouth of said groove;

means defining recesses in the faces of said second crenulations which face said groove, said recesses being sized to each receive a first crenulation;

said groove, first crenulations, said second crenulations and said recesses defining a bayonent type connection via which said retainer may be interlocked with said drive plate in a manner to hold said spring plate in position thereon.

4. A compressor as claimed in claim 2 wherein said retaining means includes an annular retainer member, said retainer member having a female thread portion formed thereon;

means defining a male thread portion on said drive plate which is arranged to cooperate with said female thread portion formed on said retainer in a manner which permits said retainer to be threaded onto said drive plate and screwed to a position wherein said plate spring is secured in a desired position.

5. In a wobble plate variable capacity compressor a drive shaft selectively connectable to a source of rotational energy;

a drive plate pivotally connected to said drive shaft in a manner to be pivotal with respect thereto and synchronously rotatable therewith;

a wobble plate operatively disposed on said drive plate, said wobble plate being supported on said drive plate by a thrust bearing and held stationary with respect to said drive plate in a manner that relative movement occurs therebetween when said drive shaft is driven to rotate; and a single annular plate spring mounted on said driven plate, said spring applying a bias to said wobble plate which urges said wobble plate into constant engagement with the thrust bearing, said annular plate spring being rotatably locked in place by a retainer detachably mounted on said drive plate.

* * * * *